United States Patent [19]

Siegler

[11] 4,288,886

[45] Sep. 15, 1981

[54] AIR BROOM

[76] Inventor: Frederick Siegler, 444 S. Citrus, Los Angeles, Calif. 90036

[21] Appl. No.: 65,996

[22] Filed: Aug. 23, 1979

[51] Int. Cl.[3] ..... A47L 5/24

[52] U.S. Cl. ..... 15/330; 15/344; 15/353; 15/405; 15/410

[58] Field of Search ..... 15/328, 329, 330, 353, 15/405, 410, 344; 417/234; 37/53

[56] References Cited

U.S. PATENT DOCUMENTS

| | | | |
|---|---|---|---|
| 1,583,528 | 5/1926 | Clements | 15/405 X |
| 2,321,231 | 6/1943 | Missmer | 15/410 X |
| 2,598,499 | 5/1952 | Breuer et al. | 15/405 X |
| 4,070,771 | 1/1978 | Yakiwchuk | 15/405 X |

FOREIGN PATENT DOCUMENTS

| | | | |
|---|---|---|---|
| 219017 | 4/1925 | United Kingdom | 15/405 |

*Primary Examiner*—Christopher K. Moore
*Attorney, Agent, or Firm*—Allan D. Mockabee

[57] ABSTRACT

An air broom for suspension from the hand of the user while standing wherein a power unit and an air impeller connected to and driven thereby support an outwardly extending hollow wand whose weight and leverage are coordinated with that of the power unit and air impeller so that the wand is cantilevered at an outward and downward angle with its remote end adjacent the ground. The apparatus is designed for flowing with a sweeping action and for gathering with a suction action.

8 Claims, 6 Drawing Figures

AIR BROOM

FIELD OF THE INVENTION

The apparatus is related to air brooms utilized in blowing dirt and leaves or the like from stairs, walks and driveways outside of buildings. However, a form thereof is adapted for use as a suction cleaner for picking up refuse rather than for blowing it from the surface to be cleaned. In either case, however, it involves a relatively light apparatus suspended from the hand of the user with his arm hanging naturally downward, the device being balanced so that its elongated tubular wand slants downwardly and forwardly and terminates adjacent the ground.

PRIOR ART

For many years it is the custom for urban gardeners to remove grass cuttings and leaves from lawns with jets of water from garden hoses. More recently gardeners, at least in some areas, have been using a stream of air in place of water. Air flow is created by an impeller driven by a power plant such as a gasoline engine which, with the impeller, is carried on the back of the user on a board similar to those used by campers and hikers when backpacking. These air brooms are rather heavy and their cost is quite high.

It is one of the objects of the invention to provide an air broom which is light in weight, economical to manufacture and which can be carried conveniently and efficiently by the user in one hand with the arm hanging in the natural position, wherein the device is so balanced that its forwardly extending hollow wand lies at a downward angle to bring the outer end of the wand close to the ground, the balance being such that the wand can be moved laterally and generally vertically by the hand in which it is supported, with the exertion of a minimum of energy.

The above and other objects will more fully apper from the following description in connection with the accompanying drawings.

Figures 1, 2, 3, 5:
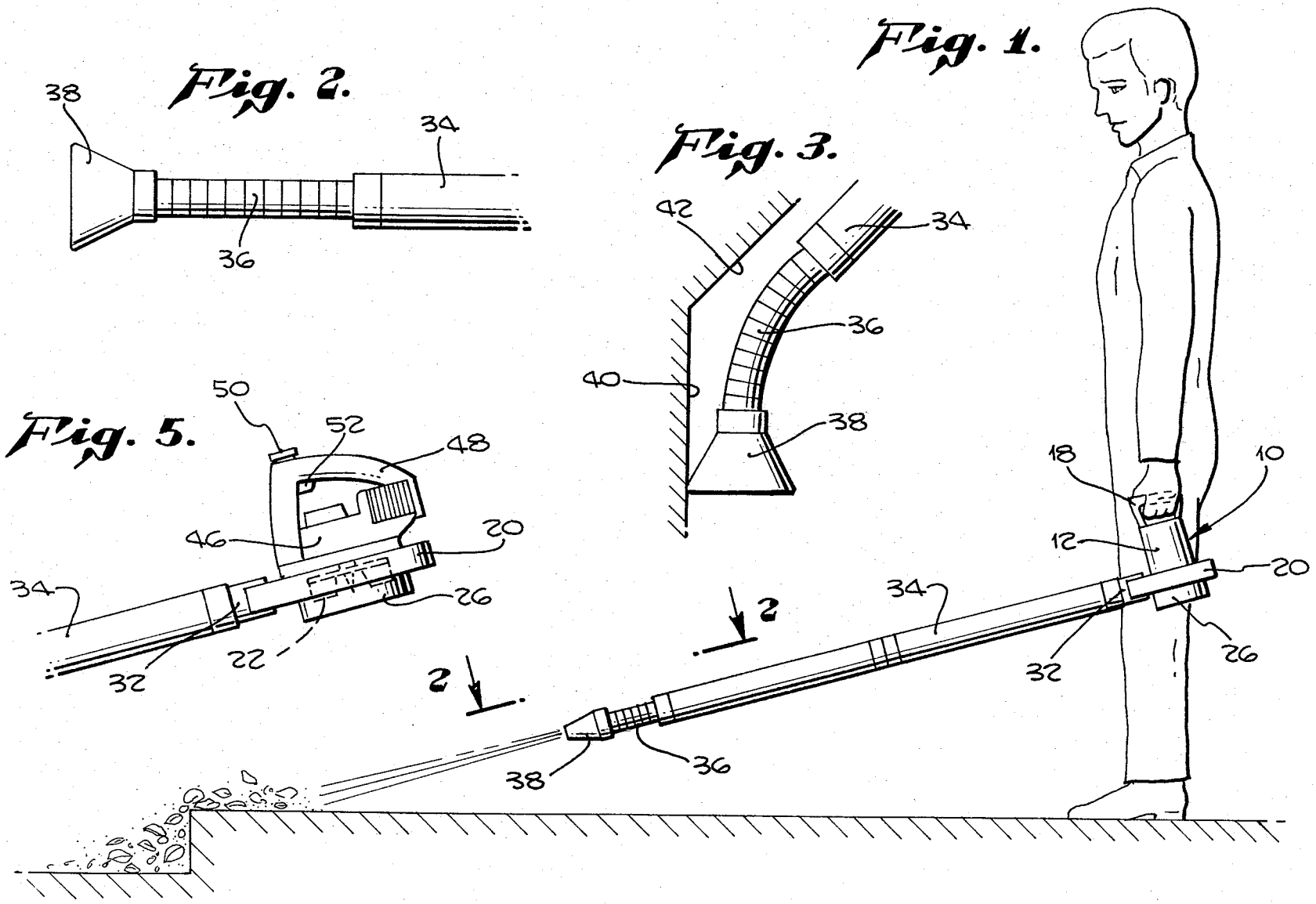
FIG. 1 is a side elevational view of an embodiment of the invention as it would be held and operated by the user.
FIG. 2 is an enlarged fragmentary view of the outer end of the hollow wand.
FIG. 3 is a view of the wand portion of FIG. 2 illustrating its flexibility in confined spaces.
FIG. 5 is a side elevational view of another embodiment in which the power unit comprises a small internal combustion engine.
Figure 4:
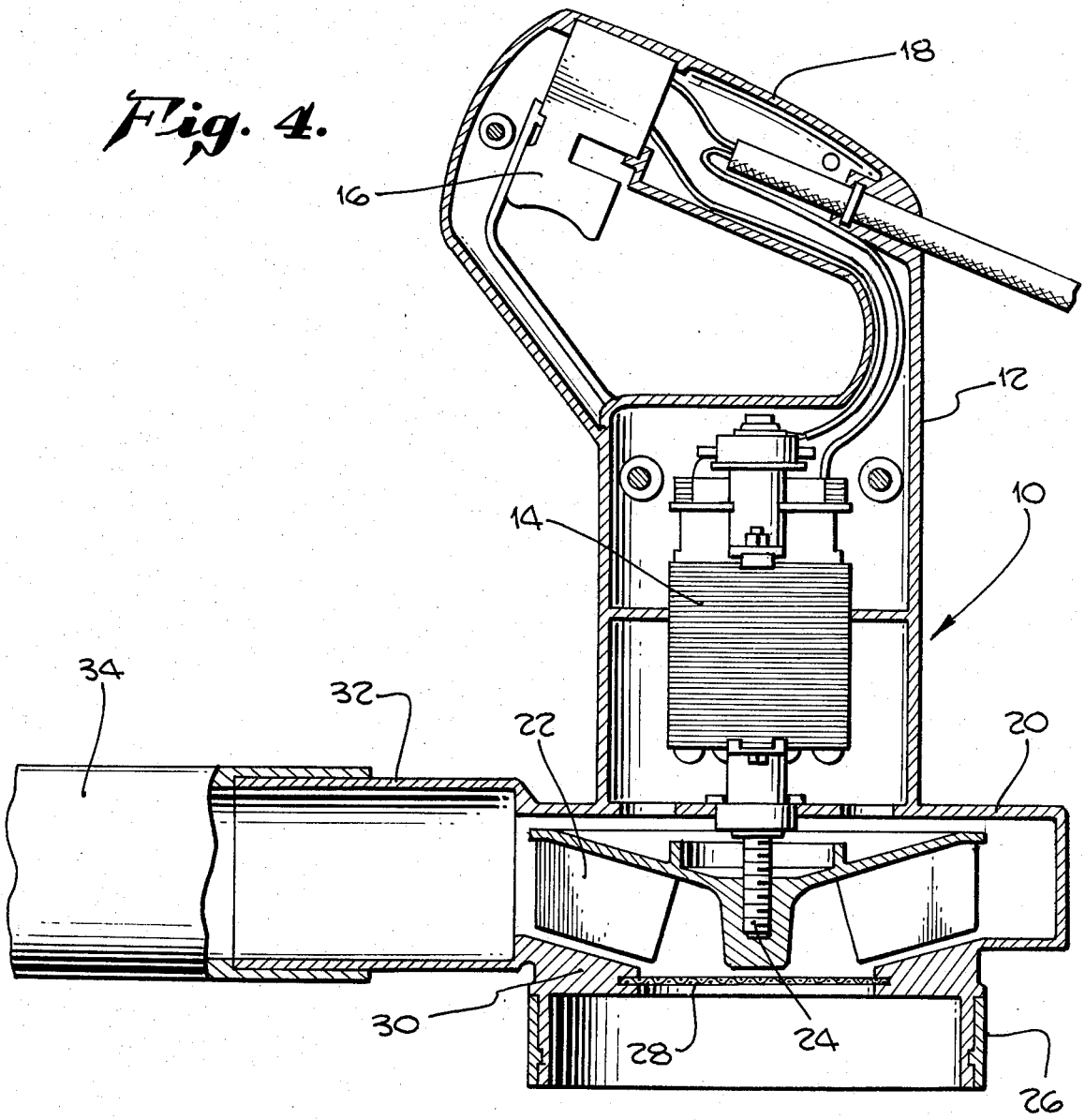
FIG. 4 is an enlarged longitudinal sectional view through the main housing containing an electric motor and an air impeller.

In FIGS. 1 and 4 there is shown a main housing 10 having a portion 12 for enclosing a generally, axially upright electric motor 14 which is shown in FIG. 4 to be wired to a finger operated switch 16 in a carrying handle 18. The handle 18 is shown extending upwardly and forwardly relative to the longitudinal axis of the housing 10 for a purpose to be described below.

The housing 10 also includes a larger diameter portion 20 which houses a rotary impeller 22 mounted on a motor shaft 24, said shaft defining the axis of rotation of the motor 14. As viewed in FIG. 4 the larger diameter housing portion 20 has below it a circular flange 26. A screen 28 lies across an opening defined by an annular web 30. In this form of the invention this is the inlet supplying air to the impeller 22. The air outlet comprises a short tube 32 integral with the general housing structure 10 and to the tube 32 is secured the inner end of a hollow air flow wand 34.

The major portion of the wand 34 may be of thin walled metal or of extruded or molded plastic and preferably it is of quite light weight consistent with sufficient strength to resist dropping on the ground or other blows to which it might be subjected. The outer end of the wand 34 may be provided with a flexible tubing portion 36 which in turn, has its outer end provided with a relatively flat outlet nozzle 38.

As shown in FIG. 1 the user of the device can stand erect with his hand held naturally down at his side with his hand grasping the handle 18. Even though the wand 34 is of light weight, its outward extension creates sufficient leverage relative to the weight of the motor 14, impeller 22 and housing 10, to cause the wand 34, which is cantilevered from the housing 10, to extend forwardly and downwardly so that the outlet nozzle 38 lies fairly close to the ground. FIG. 1 shows the apparatus in an exemplary balanced condition. Naturally the height of the user will result in variations of height of the housing 10 above the ground, requiring the user to tilt the wand 34 downwardly from a precisely balanced position, but because of the balance, the strength required to be exerted upon the handle 18 is negligible.

Also because of the relatively balanced design of the apparatus the wand 34 can be swung laterally with a rather slight movement of the hand of the user without noticeable fatigue.

By reason of the flexible tubing section 36 and the outer portion of the wand 34, it is possible to push the nozzle against a wall face such as 40 in FIG. 3 to direct the air flow from the wand generally parallel to wall 40 without interference from an adjacent angularly disposed wall portion 42.

FIG. 5 illustrates another form of the invention in which there is an impeller housing upon which is the housing 46 of a suitable small internal combustion engine. Arched over the internal combustion engine housing is a handle 48 which may be hollow to provide a gasoline reservoir fillable through a capped spout 50 and supporting a finger throttle control 52. Details of the internal combustion engine and the throttle control are not shown since they are familiar to those skilled in the art.

Figure 6:
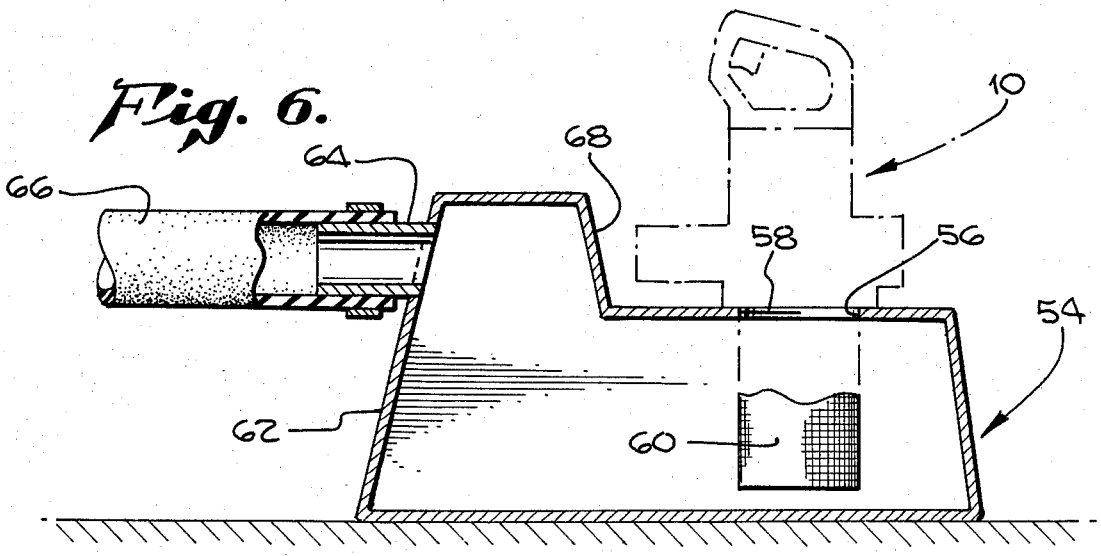
FIG. 6 is a longitudinal vertical sectional view through a dust trap interposed between the air inlet of the powered impeller housing, the housing being in broken lines, and the connected outlet end of a hollow wand or hose.

FIG. 6 shows an embodiment which includes a dust and dirt trap 54 having an upwardly disposed opening 56 to receive the flange 26 of the motor housing 10, the dust trap being securable to the flange 26 by any suitable means such as a partial screw thread 58. A cylindrical filter or screen 60 is also adapted to be mounted about the opening 56 in any suitable manner.

The dust trap 54 has a forward up standing wall 62 from the upper forward portion of which extends an air inlet tube 64 upon which is mounted a hollow wand or flexible tube 66. The wand may be relatively rigid as the wand 34 in the preceding embodiments or it may be similar to a domestic vacuum cleaner hose.

Dust trap 54 has an up standing portion 68 spaced inwardly and in the line of flow of air from wand 62 and tube 64. This causes incoming air to be diverted by the inner face of the wall 68 so that there is not a direct line of flow from the inlet tube 64 to the air inlet 56 where the dust trap connects with the motor and impeller housing 10.

The device of FIG. 6 is particularly intended to be held in a position similar to the embodiment of FIG. 1. While it can be used in doors and can be rested upon a floor, it is intended to be used out of doors as the embodiment of FIG. 1, except that instead of blowing dirt and refuse from sidewalks and other surfaces to be cleaned, it draws the waste material into the dust collector 54 from which it can be emptied into a conventional trash container.

It will of course been understood that various changes can be made in the form, details, arrangement and proportions of the various parts without departing from the spirit of the invention.

What is claimed is:

1. An air broom system comprising:

a housing, a portable power unit in said housing and having a rotary power output with a longitudinal axis of rotation, a rotary air impeller in said housing connected to said power output for rotation thereby, said housing having an air inlet and an air outlet in flow communication with said air impeller, an elongated tubular wand having an end in flow communication with one of said inlet and outlet of said housing and extending outwardly therefrom, said housing having a carrying handle at an upper portion thereof and from which the housing with said power unit and air impeller, and said elongated tubular wand are suspended with the longitudinal axis of rotation of the motor generally upright, the weight of the housing, power unit and air impeller, as an entirety, relative to the weight and leverage of the outwardly extending tubular wand, being such that the wand extends outwardly and downwardly toward the ground and terminates close to, but above the ground when the air broom system is held by the handle in operation by a standing person, said handle and wand being distinctly separate and extending from opposite ends of the housing along the rotational axis of said motor.

2. The structure in claim 1, and said handle, when the system is suspended, having a hand grip portion on a substantially horizontal axis.

3. The structure in claim 1, and a control for said power unit located in the area of said handle.

4. The structure in claim 1, and said tubular wand having a flexible end portion.

5. The structure in claim 1, and said tubular wand having a flow connection with said housing air outlet, and said housing air inlet being open to atmosphere.

6. The structure in claim 1, and a dust trap suspended from said housing and having an outlet flow connection with the air inlet portion of said housing, said dust trap having an air inlet, and a connection between said elongated hollow wand and said dust trap air inlet.

7. The structure in claim 6, and a filter in one of said air inlet portion of said housing and said dust trap.

8. The structure in claim 6, and said dust trap having an enclosed interior flow passage between its air inlet and its outer flow connection with said housing, and said dust trap having means in said interior flow passage intercepting and diverting air flowing in said passage from a direct path between the air inlet and the dust trap and its outlet flow connection.

* * * * *